US010076183B2

(12) United States Patent
Conrad et al.

(10) Patent No.: US 10,076,183 B2
(45) Date of Patent: Sep. 18, 2018

(54) SURFACE CLEANING HEAD

(71) Applicant: SharkNinja Operating LLC, Newton, MA (US)

(72) Inventors: Wayne Conrad, Hampton (CA); Nina Conrad, Hampton (CA); Dave Petersen, Bowmanville (CA)

(73) Assignee: SharkNinja Operating LLC, Needham, MA (US)

( * ) Notice: Subject to any disclaimer, the term of this patent is extended or adjusted under 35 U.S.C. 154(b) by 373 days.

(21) Appl. No.: 14/826,984

(22) Filed: Aug. 14, 2015

(65) Prior Publication Data

US 2017/0042319 A1 Feb. 16, 2017

(51) Int. Cl.

| | |
|---|---|
| ***A46B 13/02*** | (2006.01) |
| ***A47L 9/04*** | (2006.01) |
| ***A47L 9/28*** | (2006.01) |

(52) U.S. Cl.

CPC ..... *A46B 13/02* (2013.01); *A47L 9/0411* (2013.01); *A47L 9/2805* (2013.01); *A47L 9/2847* (2013.01); *A47L 9/2889* (2013.01)

(58) Field of Classification Search

CPC ..... A46B 13/02; A47L 9/0411; A47L 9/2805; A47L 2/2847; A47L 9/2889

See application file for complete search history.

(56) References Cited

U.S. PATENT DOCUMENTS

| | | | |
|---|---|---|---|
| 2,411,488 | A | 11/1946 | White |
| 2,707,792 | A | 5/1955 | Waller |
| 2,785,431 | A | 3/1957 | Pardee |
| 2,910,721 | A | 11/1959 | Burrage |
| 3,643,276 | A | 2/1972 | Worwag |
| 4,173,807 | A | 11/1979 | Maier |
| 4,333,205 | A | 6/1982 | Woodward et al. |
| 4,372,004 | A | 2/1983 | Vermillion |

(Continued)

FOREIGN PATENT DOCUMENTS

| | | | |
|---|---|---|---|
| DE | 102012207357 | A1 | 11/2013 |
| EP | 0909547 | A2 | 4/1999 |

(Continued)

OTHER PUBLICATIONS

PCT International Search Report and Written Opinion dated Mar. 31, 2016, received in related PCT Application No. PCT/US16/15370, 15 pgs.

(Continued)

*Primary Examiner* — Shay Karls

(74) *Attorney, Agent, or Firm* — Grossman Tucker Perreault & Pfleger, PLLC

(57) ABSTRACT

A surface cleaning head is disclosed. The surface cleaning head includes a housing, a brush system, and a panel open detector. The brush system includes a brush and a brush drive member drivingly connected to the brush. The brush is moveably mounted in the brush chamber and removably from the brush chamber. A panel open detector is operatively connected to a brush interruption member and the brush interruption member is operatively connected to the brush system. When the panel open detector detects that a panel on the housing is opened, the brush interruption member interacts with the brush system to prevent the brush drive member driving the brush.

16 Claims, 7 Drawing Sheets

(56) References Cited

U.S. PATENT DOCUMENTS

| | | | | |
|---|---|---|---|---|
| 4,429,430 | A | 2/1984 | Lyman | |
| 4,662,027 | A | 5/1987 | Parker et al. | |
| 4,866,804 | A | 9/1989 | Masbruch et al. | |
| 4,980,945 | A | 1/1991 | Bewley | |
| 5,014,387 | A | 5/1991 | Hays | |
| 5,309,601 | A | 5/1994 | Hampton et al. | |
| 5,452,490 | A | 9/1995 | Brundula et al. | |
| 5,495,634 | A | 3/1996 | Brundula et al. | |
| 5,632,060 | A | 5/1997 | Steinberg et al. | |
| 5,659,919 | A | 8/1997 | Kajihara | |
| 5,765,258 | A | 6/1998 | Melito et al. | |
| 5,799,364 | A | 9/1998 | Foisy et al. | |
| 5,960,514 | A | 10/1999 | Miller et al. | |
| 6,012,200 | A | 1/2000 | Murphy et al. | |
| 6,226,832 | B1 | 5/2001 | McCormick | |
| 6,324,714 | B1 | 12/2001 | Wall et al. | |
| 6,513,190 | B1 * | 2/2003 | Allgeier | A47L 9/0416 15/383 |
| 6,539,575 | B1 | 4/2003 | Cohen | |
| 6,550,099 | B2 | 4/2003 | Worwag | |
| 7,013,528 | B2 | 3/2006 | Parker et al. | |
| 7,200,893 | B2 | 4/2007 | Gerber et al. | |
| 7,316,050 | B2 | 1/2008 | Worwag | |
| 7,329,294 | B2 | 2/2008 | Conrad | |
| 7,690,079 | B2 * | 4/2010 | Boddy | A47L 9/0444 15/319 |
| 7,987,546 | B2 | 8/2011 | Poch et al. | |
| 8,037,571 | B2 | 10/2011 | Butts et al. | |
| 8,316,503 | B2 | 11/2012 | Follows et al. | |
| 8,402,601 | B2 | 3/2013 | Fahlstrom | |
| 8,434,194 | B2 | 5/2013 | Jeong et al. | |
| 8,533,904 | B2 | 9/2013 | Conrad | |
| 8,631,541 | B2 | 1/2014 | Tran | |
| 8,720,001 | B2 | 5/2014 | Courtney et al. | |
| 8,726,441 | B1 | 5/2014 | Colasanti et al. | |
| 8,776,311 | B2 | 7/2014 | Genn et al. | |
| 8,782,851 | B2 | 7/2014 | Follows et al. | |
| 8,800,107 | B2 | 8/2014 | Blouin | |
| 8,806,710 | B2 | 8/2014 | Follows et al. | |
| 2002/0092122 | A1 | 7/2002 | Zahuranec et al. | |
| 2003/0106183 | A1 | 6/2003 | Frederick et al. | |
| 2003/0145424 | A1 | 8/2003 | Stephens et al. | |
| 2003/0159240 | A1 | 8/2003 | Mertes et al. | |
| 2004/0045125 | A1 | 3/2004 | Park et al. | |
| 2006/0272122 | A1 | 12/2006 | Butler et al. | |
| 2008/0052846 | A1 | 3/2008 | Kapoor et al. | |
| 2010/0306958 | A1 | 12/2010 | Follows et al. | |
| 2011/0296648 | A1 | 12/2011 | Kah, Jr. | |
| 2012/0311802 | A1 | 12/2012 | Hinnant | |
| 2013/0198995 | A1 | 8/2013 | Eriksson | |
| 2013/0212831 | A1 | 8/2013 | Follows et al. | |
| 2014/0259521 | A1 | 9/2014 | Kowalski | |
| 2014/0331446 | A1 | 11/2014 | Eriksson | |
| 2016/0073841 | A1 | 3/2016 | Eriksson | |

FOREIGN PATENT DOCUMENTS

| | | | |
|---|---|---|---|
| GB | 583738 | | 12/1946 |
| GB | 2509925 | B | 7/2014 |
| JP | H10201682 | A | 8/1998 |
| JP | 2009045503 | A | 3/2009 |
| JP | 2011050428 | A | 3/2011 |
| WO | 0141618 | A1 | 6/2001 |
| WO | 2013104886 | A1 | 7/2013 |
| WO | 2014131105 | A1 | 9/2014 |
| WO | 2014131106 | A1 | 9/2014 |

OTHER PUBLICATIONS

U.S. Office Action dated May 12, 2017, received in related U.S. Appl. No. 14/812,734, 13 pgs.

U.S. Office Action dated Feb. 22, 2016, received in related U.S. Appl. No. 14/744,438, 29 pgs.

U.S. Office Action dated Jan. 26, 2018, received in related U.S. Appl. No. 14/812,734, 21 pgs.

* cited by examiner

SURFACE CLEANING HEAD

FIELD

This application relates to the field of surface cleaning apparatus, and more specifically to surface cleaning heads for surface cleaning apparatus.

INTRODUCTION

Surface cleaning apparatus, such as vacuum cleaners and carpet extractors, typically have a cleaning head defining a dirt inlet for dirt collected from surfaces to be cleaned. The cleaning head may include a cleaning brush which may help to dislodge dirt on the surface and/or drive dislodged dirt into the surface cleaning apparatus. Over time, the cleaning brush may become tangled with debris such as hair and larger dirt particles. A user may free the debris from the cleaning brush by hand.

SUMMARY

In one aspect of this disclosure, a brush is removable from a brush chamber in a surface cleaning head so it may be cleaned (e.g., to enable a user to remove hair that is wrapped around the brush) and/or replaced by another brush. In order to enable the brush to be removed, an openable or removable panel may be provided on the surface cleaning head (e.g., on an upper surface of the surface cleaning head). In order to prevent a user being hurt when removing the brush (e.g., by the rotation of the brush in the surface cleaning head) a switch may be provided to prevent the brush from being driven by a brush drive member (e.g., an electric motor) when the panel is opened. Accordingly, one advantage of this design is that, if the surface cleaning apparatus is accidentally actuated while a user is removing the brush from the brush chamber, the brush will not be driven by, e.g., an electric brush motor, and the user thereby hurt.

In accordance with this aspect, there is provided a surface cleaning head which may comprise a housing, a brush system, and a panel open detector. The housing may have a front end, a rear end, a brush chamber and an openable panel. The brush system may include a brush and a brush drive member drivingly connected to the brush. The brush may be moveably mounted in the brush chamber and removable from the brush chamber (e.g., removably mounted to the housing). The panel open detector may be operatively connected to a brush interruption member and the brush interruption member may be operatively connected to the brush system. When the panel open detector detects that the panel is opened, the brush interruption member may interact with the brush system to prevent the brush drive member driving the brush.

In some embodiments, the brush may be rotatably mounted in the brush chamber.

In some embodiments, the panel may be provided in an upper surface of the housing.

In some embodiments, the panel may be removably mounted to the housing.

In some embodiments, the panel may be moveably mounted (e.g., pivotally mounted) with respect to the housing between an open position, in which the brush is removable, and a closed position.

In some embodiments, a front portion of the panel may be moveably mounted to the housing and a rear portion of the panel may be moveable upwardly to the open position.

In some embodiments, the panel open detector may include an abutment member moveable between an open position and a closed position and the brush interruption member may be movable between a brush driven position and a brush non driven position in response to movement of the abutment member between closed position and the open position.

In some embodiments, the panel open detector may include a mechanical linkage drivingly connecting the abutment member to the brush interruption member.

In some embodiments, the brush drive member may include a drive motor, the brush system may include an electrical circuit and movement of the brush interruption member to the brush non-driven position may open the circuit.

In some embodiments, the panel open detector may include an abutment member moveable between an open position and a closed position and the abutment member may be provided on the housing below the rear portion of the panel.

In some embodiments, the abutment member may be slidably mounted in a switch housing, the abutment member may have an upper portion drivingly engageable by the panel and a lower portion may include the brush interruption member.

In some embodiments, the brush drive member may include a drive motor, the brush system may include an electrical circuit having a contact member and downward movement of the brush interruption member to the brush driven position may move the contact member to a circuit closed position.

In some embodiments, the abutment member may be slidably mounted in a switch housing, the abutment member may have a first portion drivingly engageable by the panel and a second portion may include the brush interruption member.

In some embodiments, the brush drive member may include a drive motor, the brush system may include an electrical circuit having a contact member and movement of the brush interruption member to the brush driven position may move the contact member to a circuit closed position.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Figure 1:
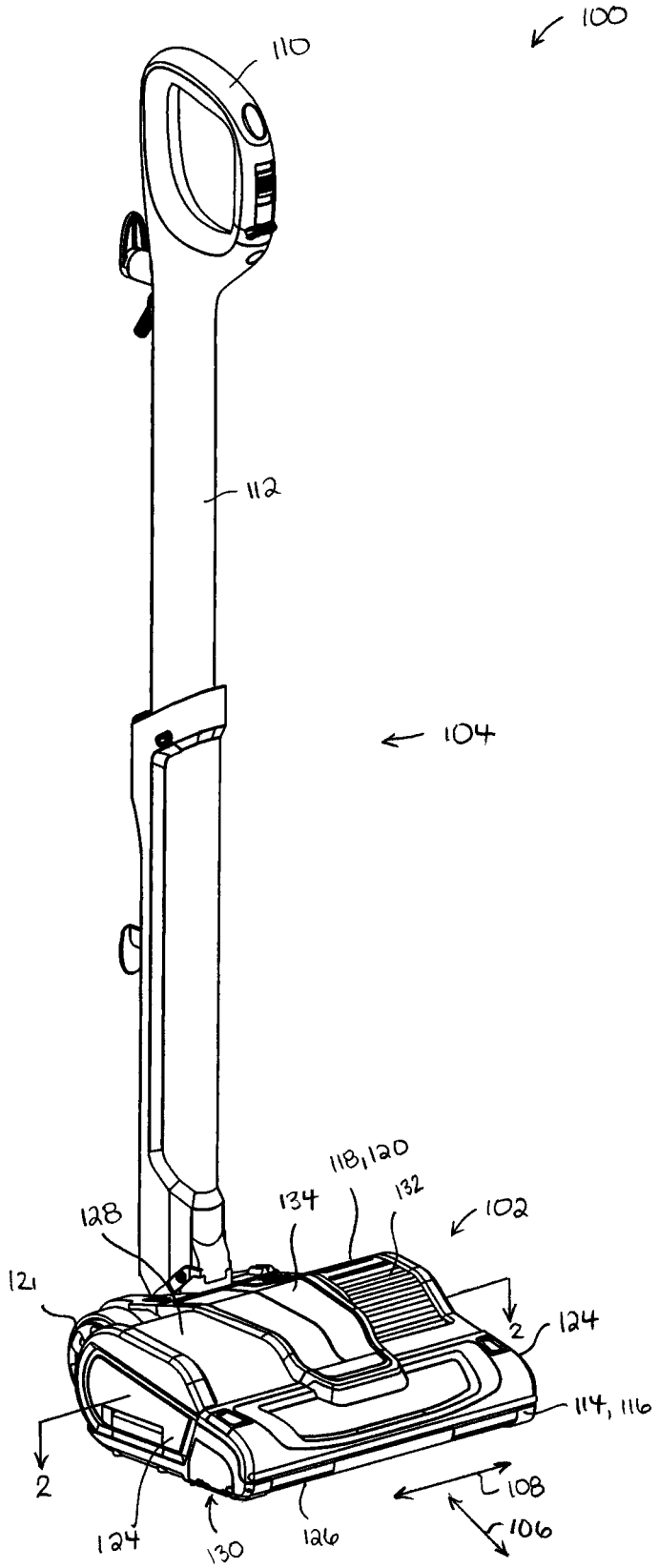
FIG. 1 is a front perspective view of a surface cleaning apparatus, in accordance with one embodiment.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (La., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

For the purpose of illustration, the surface cleaning apparatus exemplified herein is an all-in-the-head vacuum cleaner. It will be appreciated that aspects disclosed herein may be used in other surface cleaning apparatus, such as other types of vacuum cleaners (e.g. canister vacuum cleaners, upright vacuum cleaners, or handheld vacuum cleaners), or floor sweepers (e.g. without suction, air flow path, or air treatment member), extractors, or in surface cleaning heads of any such surface cleaners.

General Description of the Vacuum Cleaner

Referring to FIG. 1, an embodiment of a surface cleaning apparatus 100 is shown. The surface cleaning apparatus includes a surface cleaning head 102 and an upper portion 104 that is movably and drivingly connected to the surface cleaning head 102. In the embodiment illustrated, the surface cleaning apparatus 100 is an all in the head type vacuum cleaner in which the functional or operational components for the transport and treatment of fluid (e.g., air) entering the dirty air inlet of the vacuum cleaner (such as, for example, the suction motor, air treatment member, filters, motors, etc.) are all contained within the surface cleaning head 102 portion of surface cleaning apparatus 100.

The surface cleaning head 102 may be supported by any suitable support members, such as, for example wheels 121 and/or rollers, to allow the surface cleaning head 102 to be moved across the floor or other surface to be cleaned. The support members (e.g., wheels 121) may be of any suitable configuration, and may be attached to any suitable part of the surface cleaning apparatus, including, for example, the surface cleaning head 102 and upper portion 104.

Figure 2:
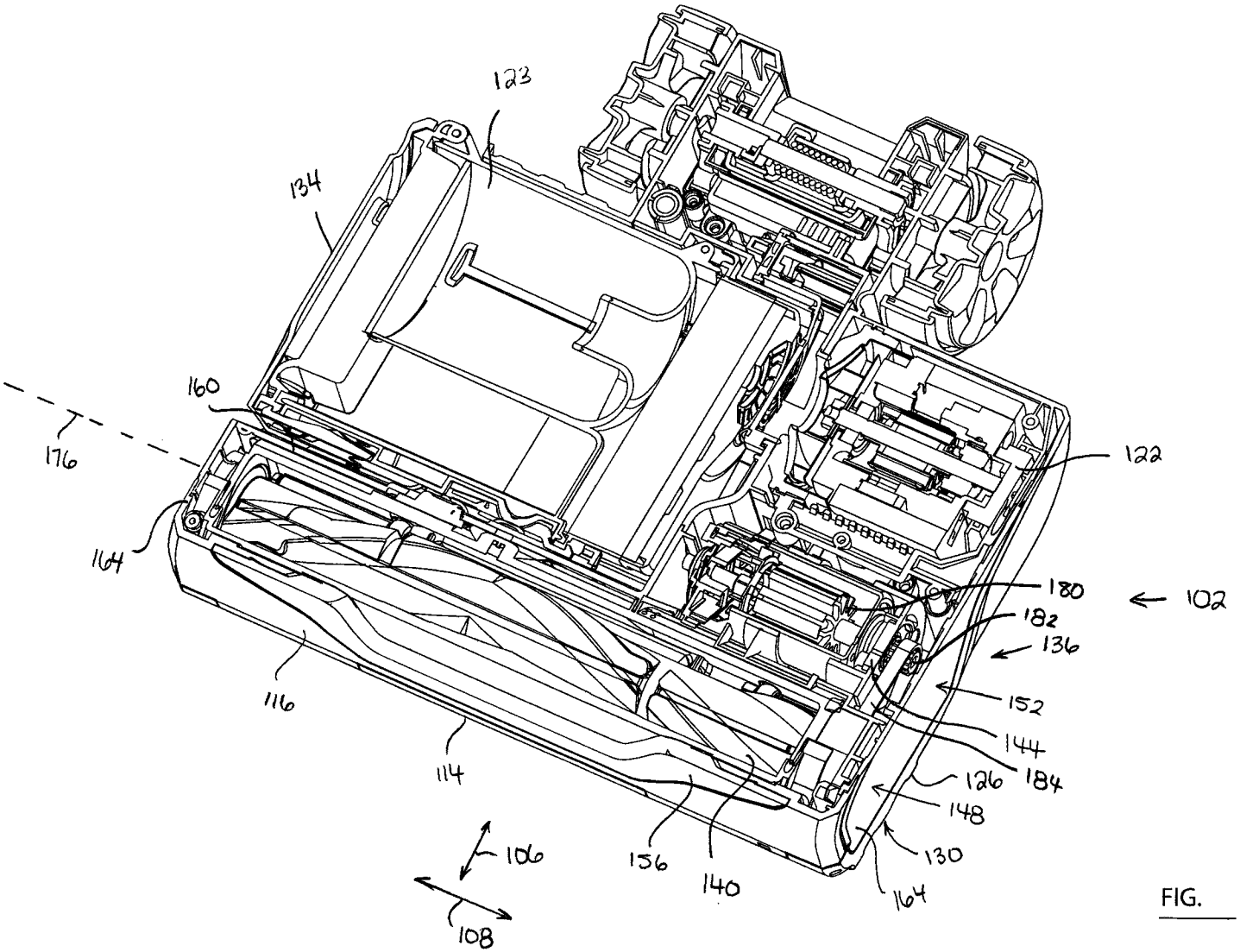
FIG. 2 is a perspective view of a cross-section taken along line 2-2 in FIG. 1.

Referring to FIGS. 1 and 2, the surface cleaning apparatus 100 preferably includes a dirty air inlet 130, preferably located at the front end of the surface cleaning head 102, a clean air outlet 132, and an air flow path or passage extending therebetween. Preferably, at least one suction motor 122 and at least one air treatment member 123 are provided in the air flow path. The air treatment member 123 may be any suitable air treatment member, including, for example, one or more cyclones (arranged in series or in parallel with each other), filters, bags and other dirt separation devices. Preferably, the at least one air treatment member 123 is provided upstream from the suction motor 122, but alternatively may be provided downstream from the suction motor 122 or both upstream and downstream from the suction motor 122. In addition to the at least one air treatment member 123, the surface cleaning apparatus 100 may also include one or more pre-motor filters (positioned in the air flow path between the air treatment member 123 and the suction motor 122) and/or one or more post-motor filters (positioned in the air flow path between the suction motor and the clean air outlet).

As exemplified in FIG. 1, upper portion 104 may be of any design known in the art that is drivingly connected to surface cleaning head 102 so as to permit a user to move surface cleaning head 102 across a surface to be cleaned (such as a floor). If upper portion 104 is moveably connected to surface cleaning head 102 about only one axis of rotation (e.g., a horizontal axis), then upper portion 104 may be used to move surface cleaning head 102 in a generally forward/backward direction of travel, indicated by arrow 106. A direction generally orthogonal to the direction of travel, indicated by arrow 108 defines a lateral or transverse direction. In some embodiments, upper portion 104 may be rotatable connected to surface cleaning head 102, such as by a swivel connection, so as to enable a user to steer the surface cleaning head 102 in the lateral direction using the upper portion 104.

Upper portion 104 may comprise a handle 110 and a drive shaft 112. Drive shaft 112 may be telescopic and/or it may be useable as an above floor cleaning wand and/or it may provide electrical cord storage and/or auxiliary cleaning tool storage and/or it may be used to hang the surface cleaning apparatus on a wall when not in use.

The upper portion 104 may include some components, such as, for example, height adjustment mechanisms, electrical cord connections, electrical cord storage members, handle, actuators, steering components and other functional, or on board energy storage systems of the surface cleaning apparatus 100.

Surface cleaning head 102 includes a cleaning head housing 134. As illustrated, cleaning head housing 134 may include a front end 114 having a front face 116, a rear end 118 spaced rearwardly from the front end 114 and having a rear face 120 and a pair of side faces 124 that are laterally spaced apart from each other and extend from the front face 116 to the rear face 120. Brush housing 134 may also have a bottom face 126 that extends between the front end 114, rear end 118 and side faces 124. The bottom face 126 is positioned to face the surface being cleaned when the surface cleaning apparatus 100 is in use.

As exemplified, a top face 128 is generally spaced apart from and overlies the bottom face 126. Together, the front face 116, rear face 120, side faces 124, bottom face 126 and top face 128 of cleaning head housing 134 co-operate to bound an interior of the surface cleaning head 102, which, in the illustrated example, is configured to house the functional components of the air flow path of the surface cleaning apparatus 100. Preferably, in an all in the head type vacuum cleaner, the surface cleaning head 102 includes the dirty air inlet 130 and the clean air outlet 132.

In the exemplified embodiment, surface cleaning head 102 has a generally rectangular footprint when viewed from above. It will be appreciated that front, rear and sides faces need not extend linearly and that surface cleaning head 102 may be of various shapes.

The forgoing is a general description of an all in the head vacuum cleaner. It will be appreciated that the following aspects may be applied to the cleaning head for any suitable surface cleaning apparatus, such as an upright vacuum, canister vacuum, handheld vacuum, or floor sweeper.

Surface Cleaning Head

Reference is now made to FIG. 2, which shows a perspective view of surface cleaning head 102 cross-sectioned along line 2-2 in FIG. 1. As exemplified, surface cleaning head 102 may include a brush system 136 having a brush 140 and a brush drive member 144 drivingly connected to the brush 140. The brush drive member 144 may be operable to move brush 140 so that brush 140 brushes against a surface to be cleaned to dislodge dirt contained on the surface for improve cleaning performance.

Figure 3:
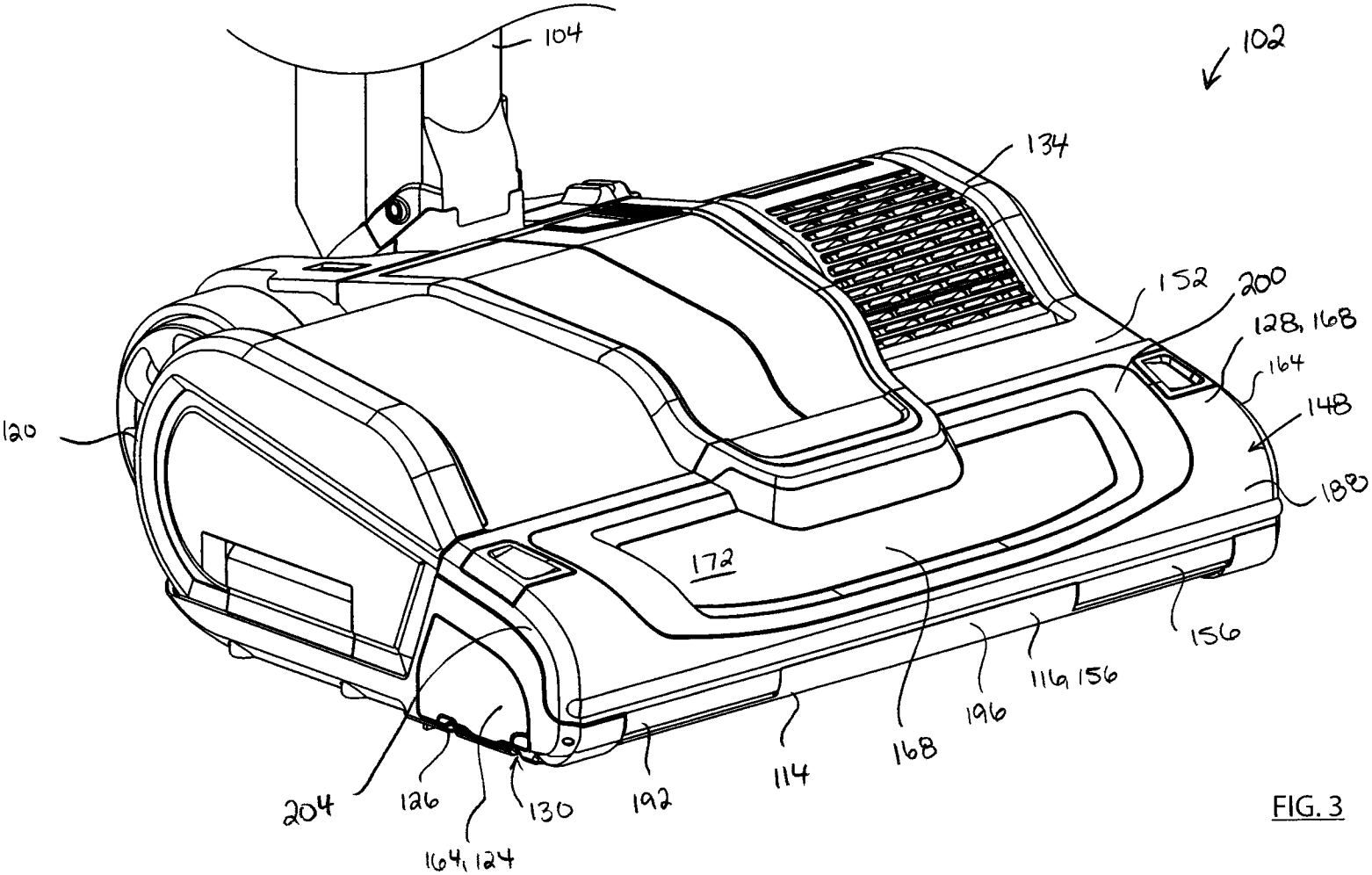
FIG. 3 is a front perspective view of a surface cleaning head of the apparatus of the apparatus of FIG. 1, with a panel in a closed position.

Brush 140 and brush drive member 144 may be located at any position known in the art and may be in any suitable position inside cleaning head housing 134. As exemplified, brush 140 may be positioned in a brush chamber 148, and brush drive member 144 may be positioned in a brush drive chamber 152. Referring now to FIGS. 2 and 3, the brush chamber 148 may include a front wall 156, a rear wall 160, two sidewalls 164, and a top wall 168. The brush chamber 148 may be located at the surface cleaning head front end 114, and, as in the illustrated embodiment, an outer surface of the brush chamber front wall 156 may form at least a portion of the surface cleaning head front face 116. The bottom side of the brush chamber 148 may be at least partially open and form all or a portion of the dirt inlet (e.g. dirty air inlet 130) of the surface cleaning apparatus 100.

As exemplified, the brush chamber 148 may extend from surface cleaning head bottom face 126 to surface cleaning head top face 128, so that an outer surface 172 of brush chamber top wall 168 forms part of the surface cleaning head top face 128, and the open, bottom side of the brush chamber 148 forms part of the surface cleaning head bottom face 126.

The brush drive chamber 152 may be positioned rearwardly of brush chamber 148 as shown. Alternatively, brush drive chamber 152 may be positioned forwardly, above, or to the side of brush chamber 148. Further, brush drive chamber 152 may be immediately adjacent (e.g. connected in contact with) brush chamber 148 as shown. Alternatively, brush drive chamber 152 may be spaced apart from brush chamber 148. For example, one or more other components or chambers may be interposed between brush chamber 148 and brush drive chamber 152. In alternative embodiments, brush drive member 144 may be situated inside brush chamber 148 and may be located internally of the brush 140, instead of a discrete brush drive chamber 152. In some embodiments, brush drive chamber 152 and/or brush drive member 144 may be positioned outside of cleaning head housing 134 (e.g. in upper portion 104).

Turning to FIG. 2, brush 140 may be movably mounted in brush chamber 148. This may permit brush 140 to brush to move relative to a surface to be cleaned to dislodge dirt on the surface. Brush 140 may be movable in any suitable fashion. For example, brush 140 may be rotatable as shown, linearly oscillating, or have any other movable brush configuration known in the cleaning arts. In the illustrated example, brush 140 is rotatable about a brush axis 176. Brush axis 176 may extend in any suitable direction. As shown, brush axis 176 may extend generally orthogonal to the travel direction 106, such as generally parallel to the lateral direction 108. Alternatively, brush axis 176 may extend generally orthogonal to the lateral direction 108, such as parallel to the travel direction 106. In some embodiments, brush axis 176 may extend in a direction between the travel direction 106 and lateral direction 108, such as approximately 45 degrees to both directions 106 and 108.

Brush 140 may be driven to move by any suitable brush drive member 144. For example, brush drive member 144 may include an electric drive motor 180 as shown, and/or any other drive device known in the cleaning arts, such as an air driven turbine drive or linear agitator. Brush drive member 144 may be drivingly connected to brush 140 in any suitable fashion. For example, brush drive member 144 may directly or indirectly drive brush 140. In the illustrated example, brush drive member 14 includes an output shaft 182. Output shaft 182 may be indirectly mechanically coupled to brush 140, such as by belt 184 as shown, gears, or any other suitable fashion. In alternative embodiments, output shaft 182 may be directly mechanically coupled to brush 140. For example, output shaft 182 may be collinear with brush axis 176.

Figure 4:
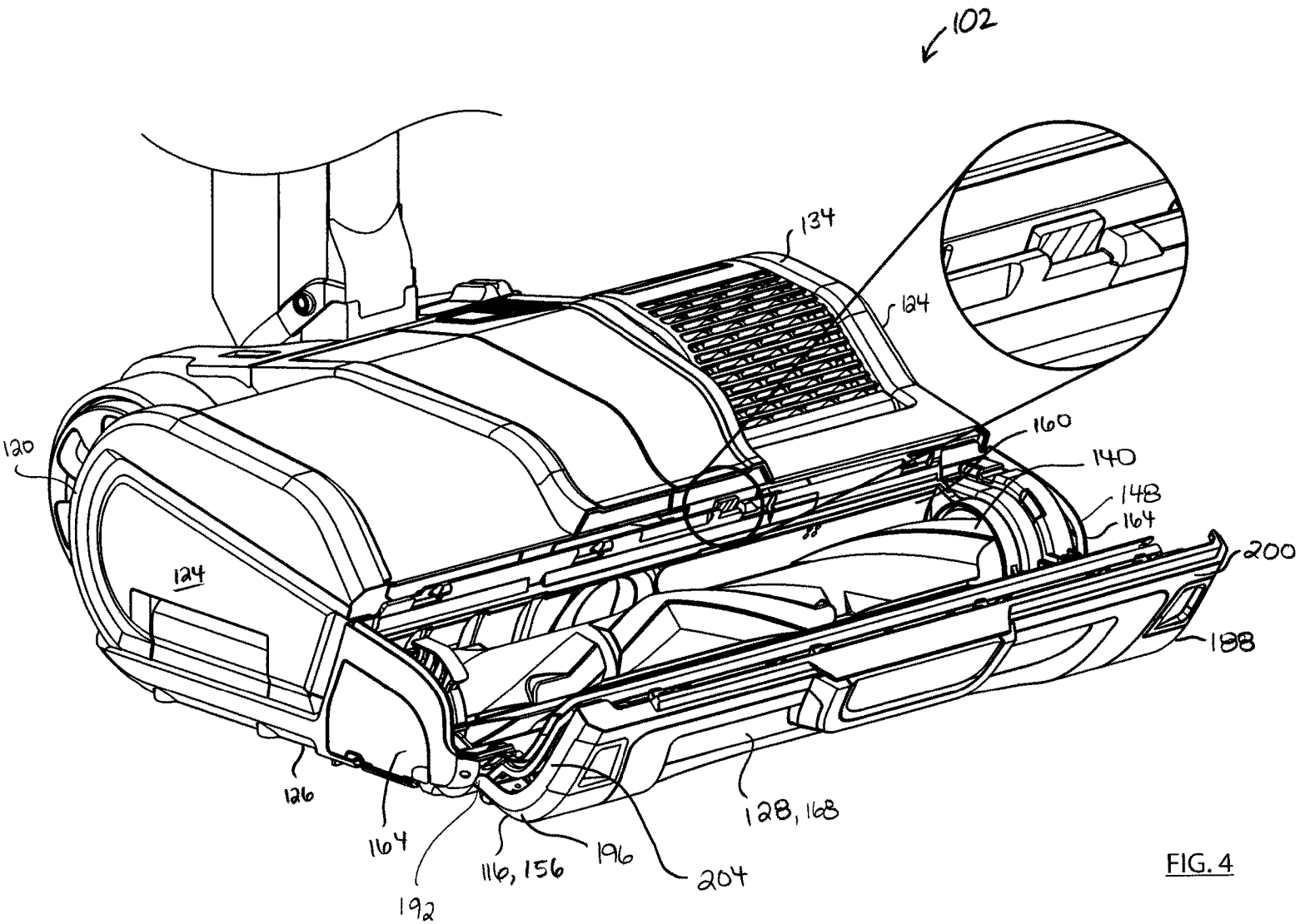
FIG. 4 is a front perspective view of the surface cleaning head of FIG. 3, with the panel in an open position and an enlargement of showing the panel open detector in the circuit open position.

Reference is now made to FIGS. 3 and 4, which show an enlarged perspective view of surface cleaning head 102. As shown, cleaning head housing 134 may include a panel 188 that is openable for providing user access to brush 140 (e.g. for cleaning, repair, or replacement of brush 140). Panel 188 may be of any size and shape that, when in an opened position, enables brush 140 to be withdrawn from the brush chamber 148. In the illustrated example, panel 188 includes a portion of the front and top faces 116 and 128 of cleaning head housing 134, and the front and top walls 156 and 168 of brush chamber 148. Alternatively, or in addition, panel 188 may include a portion of one or more other faces of cleaning head housing 134, such as rear face 120, side faces 124, or bottom face 126, and/or one or more other faces of brush chamber 148, such as rear wall 160, sidewalls 164, or the bottom wall of brush chamber 148.

Panel 188 may be movable in any suitable fashion between a panel closed position and a panel open position. For example, panel 188 may be pivotally attached to cleaning head housing 134 for rotation between the panel closed and panel open positions as shown. Alternatively or in addition, panel 188 may be slidably attached to cleaning head housing 134 for sliding between the panel closed and panel open positions. In some embodiments, panel 188 may be wholly removable from cleaning head housing 134 and removed from cleaning head housing 134 in the panel open position.

Panel 188 may be movable in any suitable direction between the panel closed and panel open positions. In the illustrated example, panel 188 is rotatable about a lower end 192 of front panel portion 196 whereby the rear panel portion 200 may be upwardly and forwardly movable in transitioning from the panel closed position (FIG. 3) to the panel open position (FIG. 4). Alternatively, or in addition, panel 188 may be rotatable about rear panel portion 200. For example, the front panel portion 196 may be upwardly and rearwardly movable in transitioning from the panel closed position to the panel open position. In other embodiments, panel 188 may be rotatable about a side panel portion 204. For example, one of side panel portions 204 may be upwardly and laterally movable in transitioning from the panel closed position to the panel open position.

As noted above, panel 188 may be openable to permit user access to brush 140, such as for cleaning, repair, or replacement of brush 140. In some embodiments, brush 140 may be removably mounted to cleaning head housing 134. This may permit brush 140 to be more easily cleaned of debris (e.g. tangled hair), and permit brush 140 to be replaced. For example, brush 140 may be removable from brush chamber 148 when panel 188 is in the panel open position. Panel 188 may also inhibit the removal of brush 140 from cleaning head housing 134 when in the panel closed position. This may mitigate the risk of brush 140 disconnecting from surface cleaning head 102 while in use. In some embodiments, panel 188 may be at least partially transparent. This may permit a user to inspect brush 140 through panel 188 while panel 188 is closed to assess whether brush 140 requires cleaning, repair, or replacement for example.

In some cases, a user may attempt to access brush 140 while brush 140 is still moving. For example, a user may open panel 188 while brush drive member 144 continues to drive movement of brush 140. This may present a safety hazard, as manual interaction with a moving brush 140 may lead to injury. For example, a moving brush 140 may be capable of burning or scraping a user's skin, or jamming if the user inserts their fingers into the brush chamber. Accordingly, it may be desirable to mitigate the risk of user injury by preventing brush drive member 144 from driving brush 140 when panel 188 is open.

Figure 5:
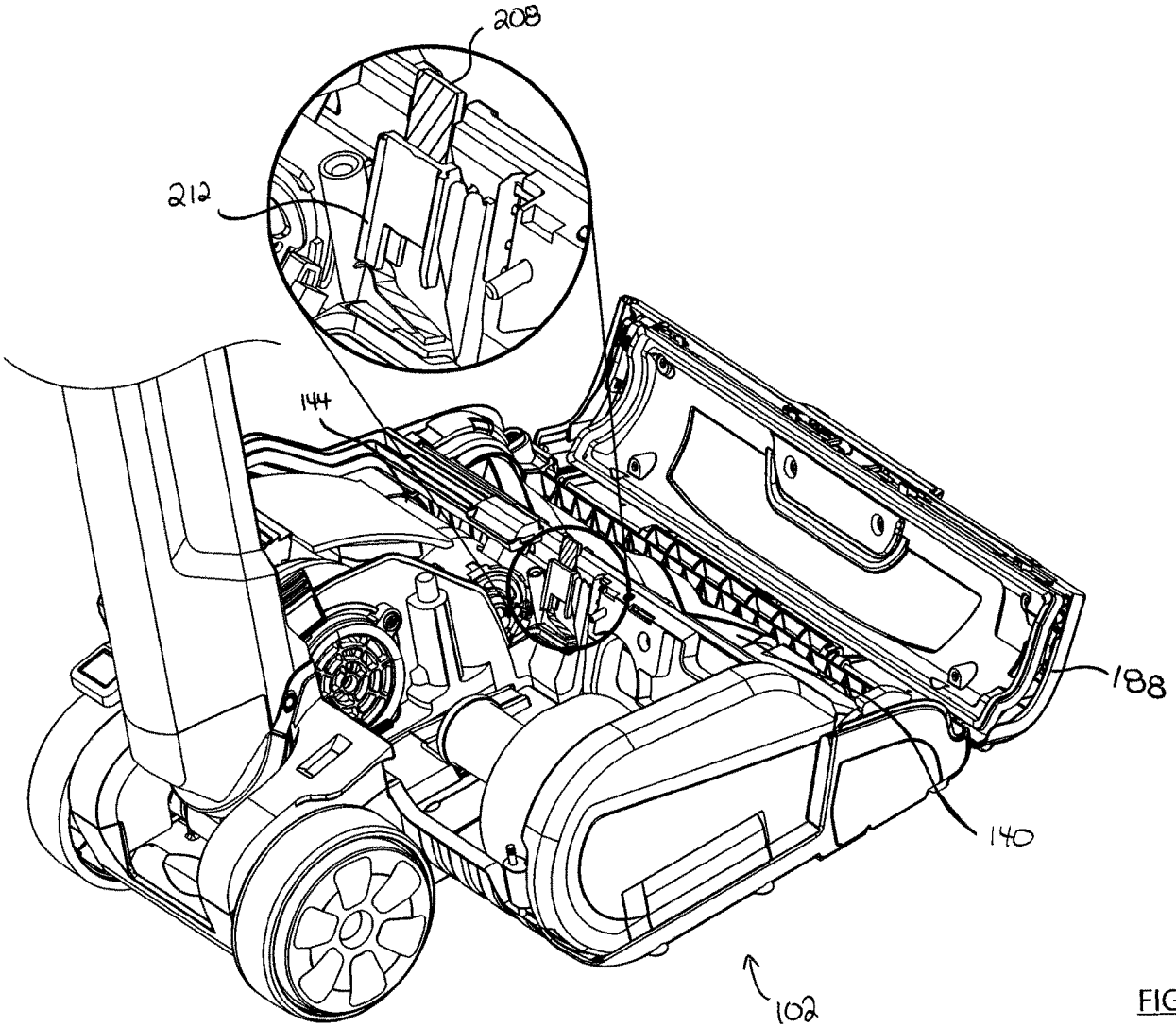
FIG. 5 is a rear perspective view of the surface cleaning head of FIG. 3, with the panel in an open position and an enlargement of showing the panel open detector in the circuit open position.

Referring now to FIG. 5, in some embodiments, surface cleaning head 102 may include a panel open detector 208 and a brush interruption member 212. Panel open detector 208 may be operable to detect the opening of panel 188 and operably connected to brush interruption member 212 (e.g., it may engage or interact with) the brush interruption member 212 to prevent brush drive member 144 from driving brush 140. In combination, panel open detector 208 and brush interruption member 212 may help prevent user injury cause by user engagement with brush 140 while brush drive member 144 is actively driving brush 140.

Figure 6:
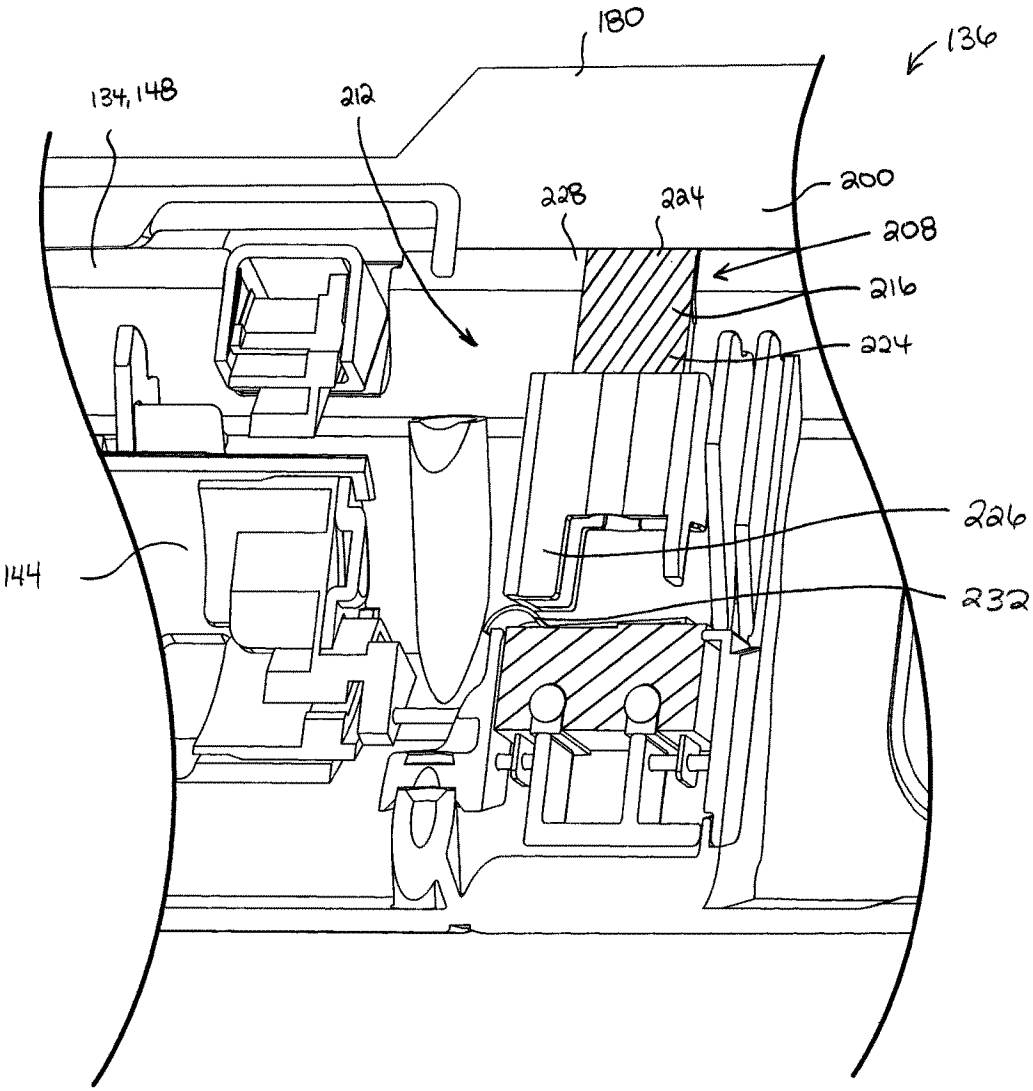
FIG. 6 is a partial cutaway cross-sectional view of the surface cleaning head of FIG. 3, with the panel in a closed position and the panel open detector in the circuit closed position; and, FIG. 7 is a partial cutaway cross-sectional view of the surface cleaning head of FIG. 3, with the panel in an open position and the panel open detector in the circuit open position.
Figure 7:
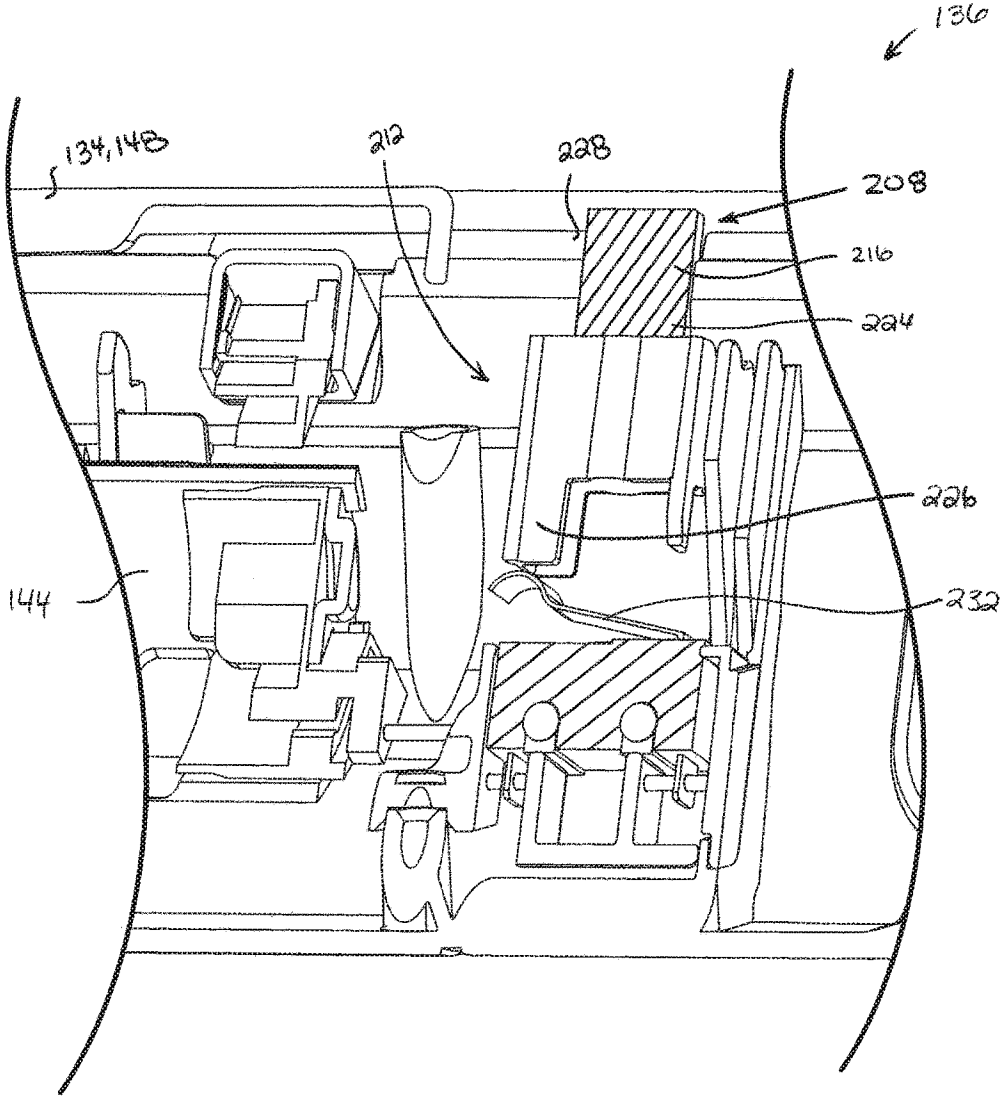

Referring to FIGS. 6 and 7, surface cleaning head 102 may include any suitable panel open detector 208. For example, panel open detector 208 may include an abutment member 216 as shown, an electronic sensor (e.g. optical encoder, or light sensor), or any other device suitable for detecting the position of panel 188 (e.g. relative to cleaning head housing 134 and/or brush chamber 148). In the illustrated embodiment, abutment member 216 may be movable between a closed position (FIG. 6) and an open position (FIG. 7). For example, abutment member 216 may be slidable, (e.g. upwardly) from the closed position to the open position as shown. Alternatively, or in addition, abutment member 216 may be rotatable or resiliently deformable (e.g. bendable) between the closed and open positions.

Panel open detector 208 may be positioned at any suitable location in surface cleaning head 102. In the illustrated example, panel open detector 208 is provided on the cleaning head housing 134 below rear panel portion 200. As shown, when panel 188 is moved to the closed position (FIG. 6), rear panel portion 200 may drivingly engage abutment member 216 to move to the closed position. For example, rear panel portion 200 may contact an upper abutment member portion 224 to slide, rotate, or resiliently deform abutment member 216 to the closed position. In alternative embodiments, panel open detector 208 may be provided on the cleaning head housing 134 below front panel portion 196 (FIG. 4) (e.g. where front panel portion 196 is upwardly movable from cleaning head housing 134), or below side panel portion 204 (FIG. 4) (e.g. where that side panel portion 204 is upwardly movable from cleaning head housing 134). As exemplified, abutment member 216 may be slidably mounted in a switch housing 228, which may at least partially constrain the sliding motion of abutment member 216. It will be appreciated that a panel lock may be provided to secure panel 188 in the closed position. Panel lock may be any member known in the art such as a latch, male and female engagement member, a magnet or the like.

Surface cleaning head 102 may include any suitable brush interruption member 212. For example, brush interruption member 212 may include an arm 226 as shown, or a solenoid. Brush interruption member 212 may be movable between a brush driven position to a brush non-driven position in response to detection by panel open detector 208 that panel 188 is open. For example, panel open detector 208 may physically engage with brush interruption member 212 to move brush interruption member arm 226 between the brush driven and brush non-driven positions. Alternatively, or in addition, panel open detector 208 may be in signal communication with brush interruption member 212 and send brush interruption member solenoid a control signal (e.g. by wire or wireless) to extend or retract. For example, brush interruption member solenoid may extend or retract to mechanically disengage brush drive member 144 from brush 140 (FIG. 2), e.g. as in a clutch.

Still referring to FIGS. 6 and 7, as exemplified, panel open detector 208 and brush interruption member 212 may be synchronously movable. For example, panel open detector 208 may comprise a mechanical linkage drivingly connecting abutment member 216 to brush interruption member 212. Alternatively, abutment member 216 may be integrally formed with or rigidly connected to brush interruption member 212. As exemplified, a lower abutment member portion 220 may include brush interruption member 212.

Brush interruption member 212 may interact with brush system 136 to prevent brush drive member 144 from driving brush 140 (FIG. 5) in any suitable fashion. For example, movement of brush drive member 144 to the non-driven position may disconnect power to brush drive member 144, or mechanically disengage brush drive member 144 from brush 140 (FIG. 5) e.g., by actuating a clutch. In the illustrated example, brush system 136 includes an electrical circuit having a contact member 232. The electrical circuit may provide electricity to power brush drive member 144, and/or control signals to direct the operation of brush drive member 144. As exemplified, contact member 232 may have a circuit closed position (FIG. 6) in which contact member 232 closes the electrical circuit, and a circuit open position (FIG. 7) in which contact member 232 opens the electrical circuit or permits the electrical circuit to be opened (e.g., contact member 232 may be biased to the open position).

When the electrical circuit is open, electricity or control signals may not flow to the brush drive member 144.

In some embodiments, contact member 232 may be biased toward the circuit closed position and brush interruption member 212 may hold contact member 232 in the circuit open position when in the non-driven position. Alternatively, as shown, contact member 232 may be biased to the circuit open position (FIG. 7), and brush interruption member 212 may hold contact member 232 in the circuit closed position (FIG. 7) when in the driven position. Contact member 232 may move to the circuit open position when panel 188 is open (e.g. under bias or interaction by brush interruption member 212), and contact member 232 may move to the circuit closed position when panel 188 is closed (e.g. under interaction by brush interruption member 212, or bias). This may open the electrical circuit when panel 188 is open to stop brush drive member 144 from driving brush 140 (FIG. 2), and close the electrical circuit when panel 188 is closed to permit brush drive member 144 to drive brush 140 (FIG. 2).

In the illustrated embodiment, contact member 232 is upwardly movable between the circuit closed and circuit open positions. As shown in FIG. 6, when panel 188 is closed, panel 188 may push panel open detector 208 to slide downwardly to the closed position, panel open detector 208 may push brush interruption member 212 to slide downwardly to the driven position, and brush interruption member 212 may push contact member 232 downwardly to the circuit closed position whereby the electrical circuit may be closed to permit electricity and/or control signals to reach brush drive member 144. This may permit brush drive member 144 to drive brush 140 (FIG. 5).

Turning to FIG. 7, when panel 188 is opened, contact member 232 may move under bias to the circuit open position and push brush interruption member 212 upwardly to the brush non-driven position, and brush interruption member 212 may push panel open detector 208 to the open position. This may open the electrical circuit to brush drive member 144, which may prevent brush drive member 144 from driving brush 140 (FIG. 5). Accordingly, brush drive member 144 may cease to drive brush 140 (FIG. 5) when panel 188 is open to permit a user to safely access brush 140 for removal, cleaning, and/or replacement.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning head comprising:

(a) a housing having a front end, a rear end, a brush chamber, a brush drive chamber and an openable panel, the brush chamber including a front wall, a rear wall, two side walls and a top wall, and wherein the openable panel includes the top wall of the brush chamber such that the openable panel covers the brush chamber without covering the brush drive chamber;

(b) a brush system comprising a brush and a brush drive member drivingly connected to the brush, wherein the brush is moveably mounted in the brush chamber and removable from the brush chamber, and wherein the brush drive member is positioned in the brush drive chamber; and, (c) a panel open detector operatively connected to a brush interruption member and the brush interruption member is operatively connected to the brush system wherein when the panel open detector detects that the panel is opened, the brush interruption member interacts with the brush system to prevent the brush drive member driving the brush.

2. The surface cleaning head of claim 1 wherein the brush is rotatably mounted in the brush chamber.

3. The surface cleaning head of claim 1 wherein the panel is provided in an upper surface of the housing.

4. The surface cleaning head of claim 3 wherein the panel is removably mounted to the housing.

5. The surface cleaning head of claim 3 wherein the panel is moveably mounted with respect to the housing between an open position, in which the brush is removable, and a closed position.

6. The surface cleaning head of claim 5 wherein a front portion of the panel is moveably mounted to the housing and a rear portion of the panel is moveable upwardly to the open position.

7. The surface cleaning head of claim 6 wherein the panel open detector comprises an abutment member moveable between an open position and a closed position and the abutment member is provided on the housing below the rear portion of the panel.

8. The surface cleaning head of claim 7 wherein the abutment member is slidably mounted in a switch housing, the abutment member has an upper portion drivingly engageable by the panel and a lower portion comprises the brush interruption member.

9. The surface cleaning head of claim 8 wherein the brush drive member comprises a drive motor, the brush system comprises an electrical circuit having a contact member and downward movement of the brush interruption member to the brush driven position moves the contact member to a circuit closed position.

10. The surface cleaning head of claim 7 wherein the abutment member is slidably mounted in a switch housing, the abutment member has a first portion drivingly engageable by the panel and a second portion comprises the brush interruption member.

11. The surface cleaning head of claim 10 wherein the brush drive member comprises a drive motor, the brush system comprises an electrical circuit having a contact member and movement of the brush interruption member to the brush driven position moves the contact member to a circuit closed position.

12. The surface cleaning head of claim 1 wherein the panel open detector comprises an abutment member moveable between an open position and a closed position and the brush interruption member is movable between a brush driven position and a brush non-driven position in response to movement of the abutment member between the closed position and the open position.

13. The surface cleaning head of claim 12 wherein the panel open detector comprises a mechanical linkage drivingly connecting the abutment member to the brush interruption member.

14. The surface cleaning head of claim 12 wherein the brush drive member comprises a drive motor, the brush system comprises an electrical circuit and movement of the brush interruption member to the brush non-driven position opens the circuit.

15. The surface cleaning head of claim 1 wherein the brush is removably mounted to the housing.

16. The surface cleaning head of claim 1 wherein the openable panel includes a rear panel portion, a front panel portion and side panel portions, and, wherein the panel open detector is provided on the housing below at least one of the rear panel portion, the front panel portion, and the side panel portion.

* * * * *